US006962300B2

(12) United States Patent
Zehr

(10) Patent No.: US 6,962,300 B2
(45) Date of Patent: Nov. 8, 2005

(54) STATIONARY CONE OVER TUB

(75) Inventor: Melvin A. Zehr, Caldwell, ID (US)

(73) Assignee: Diamond Z Manufacturing, Caldwell, ID (US)

( * ) Notice: Subject to any disclaimer, the term of this patent is extended or adjusted under 35 U.S.C. 154(b) by 385 days.

(21) Appl. No.: 10/008,407

(22) Filed: Nov. 13, 2001

(65) Prior Publication Data

US 2002/0056775 A1 May 16, 2002

Related U.S. Application Data

(60) Provisional application No. 60/249,401, filed on Nov. 15, 2000.

(51) Int. Cl.[7] ..... B02C 13/286

(52) U.S. Cl. ..... 241/73; 241/186.4; 241/285.3; 241/101.761

(58) Field of Search ..... 241/101.761, 186.4, 241/189.1, 285.3, 73, 224

(56) References Cited

U.S. PATENT DOCUMENTS 4,106,706 A 8/1978 Burrows ..... 241/186.2
4,236,675 A * 12/1980 Bladykas ..... 241/65
4,997,135 A * 3/1991 Zehr ..... 241/101.761
5,207,391 A 5/1993 Anderson ..... 241/186.4
5,238,193 A * 8/1993 Pearce ..... 241/19
5,297,744 A * 3/1994 Clinton ..... 241/81
5,375,784 A * 12/1994 Worley ..... 241/37.5
5,419,502 A * 5/1995 Morey ..... 241/101.761
5,626,298 A 5/1997 Arnoldy ..... 241/101.761
5,716,014 A * 2/1998 Tamura et al. ..... 241/36
5,950,942 A * 9/1999 Brand et al. ..... 241/101.761
6,260,778 B1 7/2001 Wenger ..... 241/73

* cited by examiner

*Primary Examiner*—Mark Rosenbaum
(74) *Attorney, Agent, or Firm*—Robert L. Shaver; Dykas, Shaver & Nipper

(57) ABSTRACT

An apparatus for assisting in loading material to be ground into a rotatable drum assembly and protecting the rotating means of the assembly. A stationary drum assembly having a frustoconical stationary sidewall is configured to aid in feeding material into the rotatable drum space attached to a frame suspended over the rotating drum space. The stationary sidewall has a smaller diameter end adjacent to the rotatable drum assembly, and a large diameter end positioned atop the rotatable drum. Whereby when material is loaded into the large diameter end of the frustoconical stationary sidewall, the material passes through the stationary sidewall into a drum space where material is contacted by the grinding means and ground into pieces.

7 Claims, 3 Drawing Sheets

STATIONARY CONE OVER TUB

PRIORITY

This application incorporates by reference and claims priority from a provisional Patent Application, Ser. No. 60/249,401 filed on Nov. 15, 2000 entitled "Retractable Rod Screens."

BACKGROUND OF THE INVENTION

1. Field of the Invention

The present invention generally relates to grinding machines and more particularly to rotating hoppers and feeding assemblies for grinding machines.

2. Background Information

Many different kinds of grinding machines are known in the prior art. Grinding machines include those machines that use a grinding means such as hammer mills, drum chippers, and wheel chippers to grind various materials. Grinding machines are used for grinding tree stumps and slash from logging operations; construction debris from damaged buildings, landfill garbage, tires for compacting purposes, and even apples for apple juice.

Generally and typically, these grinding machines utilize a grinding assembly attached to a frame to grind the material. A hopper or loading container is positioned proximate to the grinding apparatus and introduces material to be ground into the grinding means. In use, the materials are loaded into the hopper, which then holds a quantity of the material to be ground and feeds the material as needed into the grinding means where the material is broken apart or pulverized.

In order to facilitate the passage of materials into the grinding means various forms of hoppers and containers can be used. Some hoppers are stationary. The problem with these hoppers is that as materials sit inside the hopper materials can get stuck and not feed into the grinding means. Also, because the materials are not agitated materials can bridge or arch over the grinding means thus preventing passage of material into the grinding means. As a result, the machines operate less efficiently because material is not fed into the grinding means as rapidly as it can be accepted.

One way of resolving this problem is to utilize a rotating hopper. Material is placed into a hopper, which is rotated by a rotating means. This rotating action, then feeds material into the grinding means by moving the hopper where the material to be ground is located. The movement of the container prevents the stasis of the material in any one location relative to the grinding means, and facilitates the movement of the material to be ground toward the grinding means.

In utilizing a rotating hopper, however, other problems arise. As the drum rotates material may move outward from the drum and into the rotating means. Although these grinding means can grind up hard materials such as stone, wood, metal, and rubber when something as simple as a videotape gets into the rotating means, the means can become fouled and the drum will no longer rotate. When the rotating means no longer works, the material in the drum can no longer be fed into the teeth or hammers and the entire operation must stop. This results in significant losses due to down time and back ups that occur while the rotating means is repaired or replaced. What is needed is a mechanism to prevent material from spilling over the rotating drum into the rotating means. It is an object of this invention to provide a means for preventing material to be ground from entering into the rotating means of a rotating drum on a grinding machine. It is a further object to provide a means for protecting the rotating means of a rotating hopper. It is a further object of the invention to provide a means for efficient filling of a hopper.

SUMMARY OF THE INVENTION

The present invention is an apparatus for assisting in loading material to be ground into a rotatable drum assembly and protecting the rotating means of the assembly. The rotatable drum assembly has a rotatable circumvolving sidewall and a stationary bottom surface, defining therein a rotating drum space, a rotating means, and an opening within the bottom surface for allowing passage of material from the hopper to a grinding means. The rotatable drum assembly is positioned in such a manner whereby the opening in the bottom surface allows the passage of material to be ground from the drum base into the grinding means.

The invention comprises a stationary drum assembly having a frustoconical stationary sidewall configured to aid in feeding material into the rotatable drum space attached to a frame suspended over the rotating drum space. The stationary sidewall has a smaller diameter end adjacent to the rotatable drum assembly, and a large diameter end positioned atop the rotatable drum. Whereby when material is loaded into the large diameter end of the frustoconical stationary sidewall, the material passes through the stationary sidewall into the rotatable drum space where the material is contacted by the grinding means through the opening in the bottom surface of the rotatable drum assembly. The frustoconical stationary sidewall encourages the passage of material into the rotatable drum space and prevents spillage of material over the sides of the rotatable drum assembly into the rotating means thus preventing damage to the rotating means. This allows the grinding to take place more efficiently with fewer breakdowns, less damage to the rotating means, and less spillage of material out of the rotating drum.

Still other objects and advantages of the present invention will become readily apparent to those skilled in this art from the following detailed description wherein I have shown and described only the preferred embodiment of the invention, simply by way of illustration of the best mode contemplated for carrying out the invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
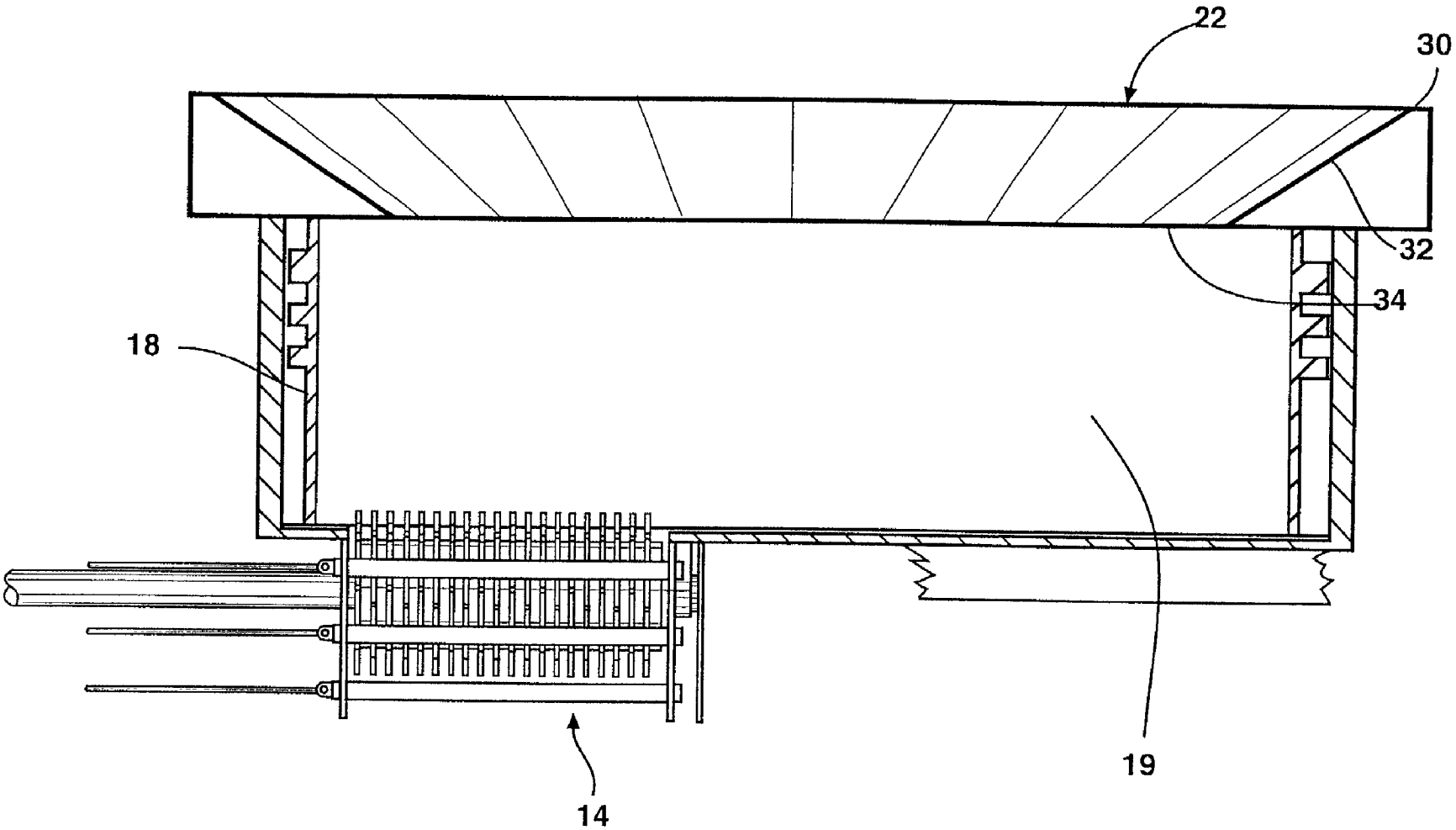
FIG. 1 is an elevational view of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is an apparatus for facilitating the loading of material into the rotating hopper of a grinding machine and for protecting the rotating means of the machine from damage caused by the entry of material to be ground into the rotating means of the hopper.

Referring initially to FIG. 1, we see an elevational view of a first embodiment of the invention and its placement over a rotatable drum assembly of a grinding machine. The stationary cone 22 comprises a frustoconically shaped piece having a large end 30, a small end 34, and a sidewall 32. In use, the stationary cone 22 is located above a rotatable drum assembly 18 and facilitates the passage of material into the rotating drum space 19 preventing spillage of material over the sides of the drum assembly and protecting the rotating means (not shown) from damage and contamination caused by over spills. In use the smaller end of the stationary wall 34 may extend into the rotating drum space 19. The rotating drum assembly 18 rotates; moving material from the rotating drum space 19 into the grinding means 14.

Figure 2:
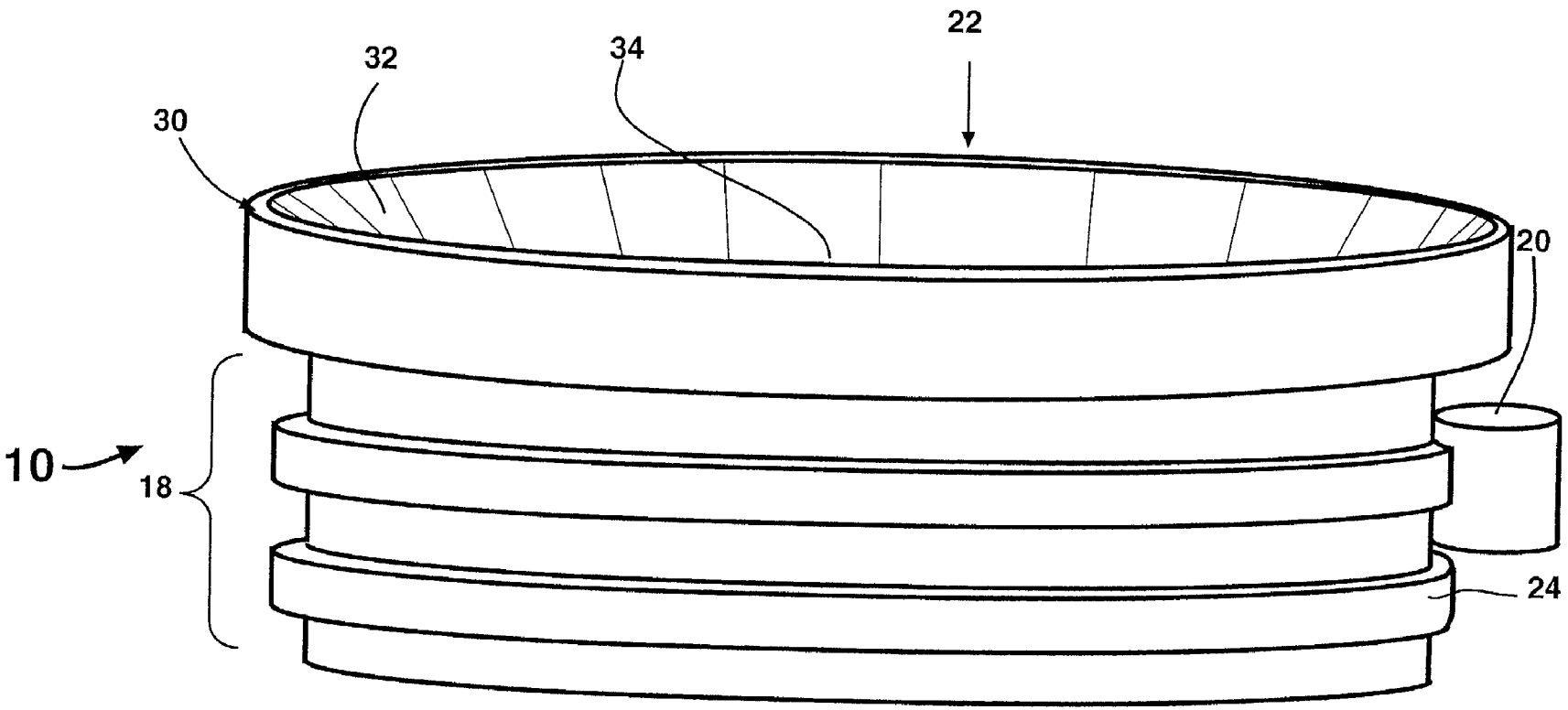
FIG. 2 is a perspective view of the stationary frustoconical sidewall adjacent to a rotating drum assembly showing the rotating means and means for tilting.

Referring now to FIG. 2, a perspective view of the same embodiment as shown in FIG. 1 is shown. In this embodiment a stationary cone 22, having a large end 30, a circumvolving wall 32, and a small end 34, is placed on top of and adjacent to a rotatable drum assembly 18. A means for rotating the drum assembly 20 is protected from over spillage by the position of the stationary cone 22. The rotating means 20 for rotating the assembly rotatable sidewall assembly can be driven from the same motor or engine that powers the grinding means or have a separate electric, gasoline, or diesel engine of its own or may be powered by a hydraulic drive.

In this embodiment a tilting means 24 allows the orientation of the rotating drum and the stationary cone to be altered. In use, the material to be ground such as garbage, wood chips, etc. is dumped into the frustoconical stationary cone 22. The material is then directed into the rotating drum assembly 18 which then holds material and puts a portion of material to be ground in contact with the grinding means through an opening in the bottom of the rotating drum space (not shown).

Figure 3:
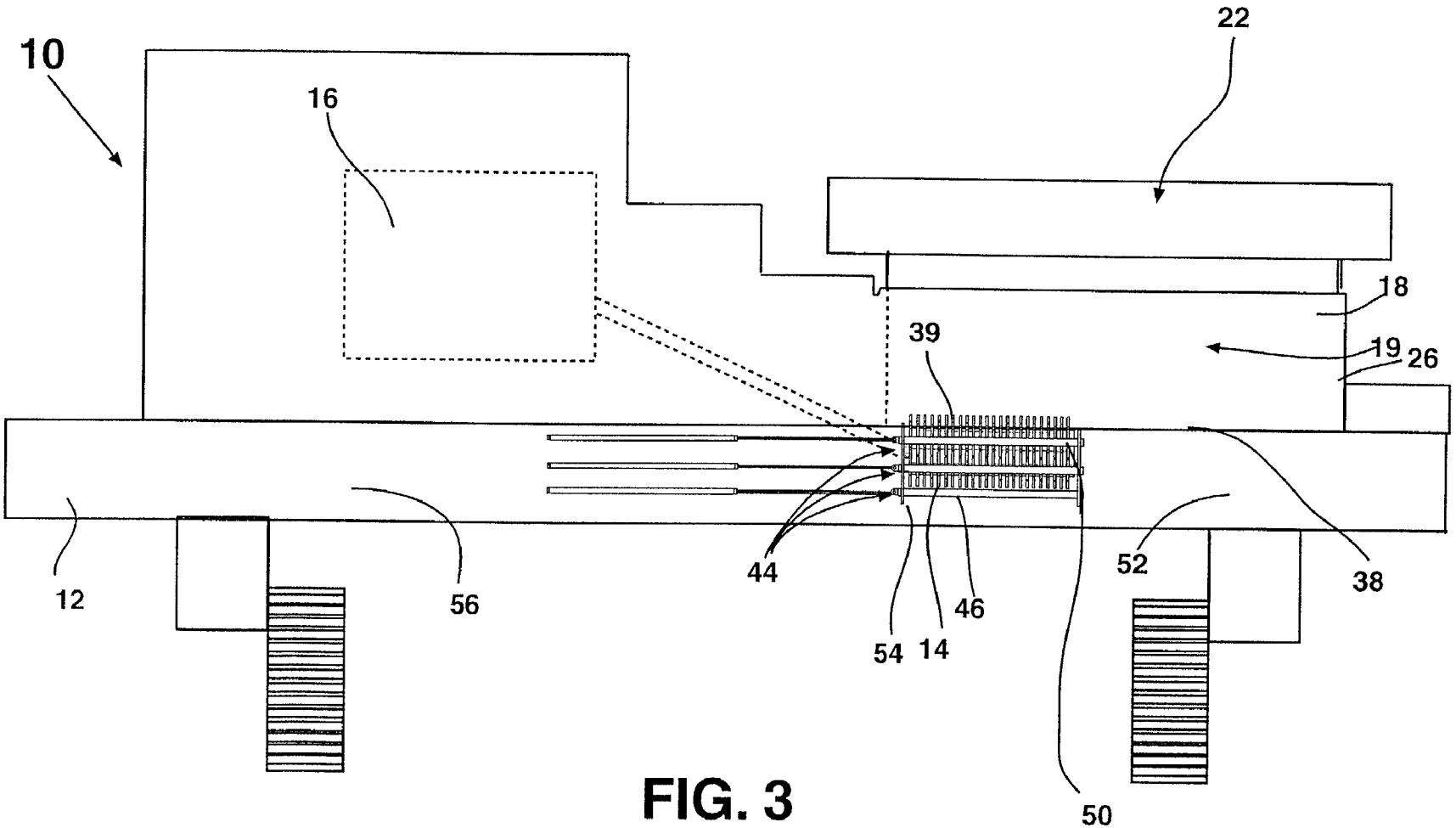
FIG. 3 is an elevational view of the invention included as a part of an apparatus for grinding material

Referring now to FIG. 3 an apparatus for grinding material is shown, made up of a grinder frame 12, a grinding means 14 mounted to the frame; a drive means 16 operatively connected to the grinding means 14; a rotatable drum assembly 18. The rotatable drum assembly 18 is positioned for alignment of the opening in the bottom surface (not shown) with the grinding means 14 and allows the passage of material to be ground from the rotatable drum space 19 into the grinding means 14. A stationary drum assembly 22 having a frustoconical stationary sidewall (not shown) protects the rotating means (not shown) of the rotating drum assembly 18 and aids in feeding material into the rotatable drum space 19.

In use, material is loaded through the stationary cone 22 into the rotating drum assembly 18, where it is rotated and fed into the grinding means 14 where it is ground until exiting through the bottom of the grinding means 14 below the frame 12.

In a preferred embodiment the grinder frame 12 has a left rail 56 and a right rail 52. The grinder means 14 is a hammermill assembly 14 attached to the frame 12 having a rotatable hammermill with extending hammers, and a hammermill screen 43 having a plurality of bars 44 mounted within the screen chamber positioned below the hammermill. The screen chamber 46 has a first end wall 50 attached to the right rail 52 of the frame and a second end wall 54 attached to the left rail 56 of the frame. The first end wall 50 and second end wall 56 each define bar passages and provide support for the bars.

The drive means 16 which powers the grinding means can be an electric, or gasoline motor or a diesel engine. The rotating drum assembly 18 has a rotatable circumvolving sidewall 26, and a stationary bottom surface 38, defining therein a rotating drum space. The stationary bottom surface has an opening therethough 39 for the passage of material to be ground from the rotating drum assembly to the grinding means 14.

Whereby material is loaded into the larger diameter end of the frustoconical stationary sidewall 30, the material passes through the stationary side wall 32 into the rotatable drum space 19 where the material is contacted by the grinding means 14 through the opening in the bottom surface of the rotatable drum assembly 19.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. An apparatus for grinding material comprising:

a grinder frame;

a grinding means mounted to the frame;

a drive means operatively connected to the grinding means;

a rotatable drum assembly having a rotatable circumvolving side wall, a stationary bottom surface, and defining therein a rotating drum space, the bottom surface having an opening therethough for the passage of material to be ground, the rotatable drum assembly attached to the grinder frame in a position for alignment of the opening in the bottom surface with the grinding means for allowing the passage of material to be ground from the drum space into the grinding means;

means for rotating the rotatable side wall; and a stationary drum assembly having a frustoconical stationary side wall configured to aid in feeding material into the rotatable drum space the stationary side wall having a smaller diameter end adjacent to the rotatable drum assembly and a larger diameter end, positioned atop the rotatable drum;

whereby material is loaded into the larger diameter end of the frustoconical stationary sidewall, the material passes through the stationary side wall into the rotatable drum space where the material is contacted by the grinding means through the opening in the bottom surface of the rotatable drum assembly.

2. The apparatus for grinding material of claim 1 which further comprises means for tilting the rotatable drum and stationary drum assemblies from a vertical position to a tilted position.

3. The apparatus for grinding material of claim 1 wherein the diameter of the stationary wall at its largest end is greater than the diameter of the circumvolving rotatable wall.

4. The apparatus for grinding material of claim 1 wherein the diameter of the stationary wall at its largest end is greater than the diameter of the circumvolving rotatable wall and the diameter of the stationary wall at its smaller end is less than the diameter of the circumvolving rotatable wall.

5. The apparatus for grinding material of claim 4 wherein the stationary wall at its smaller end extends into the rotating drum space.

6. The apparatus for grinding material of claim 1, wherein said grinding means further comprises:

a screen chamber having a first end wall attached to a right rail of the frame and a second end wall attached to a left rail of the frame, the first and second end walls each defining bar passages and providing support for the bars; and a hammermill assembly attached to the frame having a rotatable hammermill with extending hammers, and a hammermill screen having a plurality of bars mounted within the screen chamber positioned below the hammermill.

7. An apparatus for grinding material comprising:

a grinder frame;

a hammermill assembly attached to the frame having a rotatable hammermill with extending hammers, and a hammermill screen having a plurality of bars mounted within the screen chamber positioned below the hammermill;

a screen chamber having a first end wall attached to the right rail of the frame and a second end wall attached to the left rail of the frame, the first and second end walls each defining bar passages and providing support for the bars;

a drive means operatively connected to the grinding means;

a rotatable drum assembly having a rotatable circumvolving side wall, a stationary bottom surface, and defining therein a rotating drum space, the bottom surface having an opening therethough for the passage of material to be ground, the rotatable drum attached to the grinder frame in a position for alignment of the opening in the bottom surface with the grinding means for allowing the passage of material to be ground from the drum space into the grinding means;

means for rotating the rotatable side wall;

a stationary drum assembly having a frustoconical stationary side wall configured to aid in feeding material into the rotatable drum space attached to the frame, the stationary side wall having a smaller diameter end extending into the rotatable drum assembly and a larger diameter end, attached to the grinder frame and positioned atop the rotatable drum wherein the diameter of the stationary wall at its largest end is greater than the diameter of the circumvolving rotatable wall; and means for tilting the rotatable drum and stationary drum assembly from a vertical position to a tilted position;

whereby material is loaded into the larger diameter end of the frustoconical stationary sidewall, the material passes through the stationary side wall into the rotatable drum space where the material is contacted by the hammerends of the hammermill through the opening in the bottom surface of the rotatable drum assembly.

* * * * *